United States Patent [19]

Morgan

[11] 4,424,687

[45] Jan. 10, 1984

[54] ICE RACK FOR USE IN PORTABLE ICE CHEST

[76] Inventor: Marshall M. Morgan, 8210 Brae Acres, Houston, Tex. 77074

[21] Appl. No.: 340,100

[22] Filed: Jan. 18, 1982

[51] Int. Cl.[3] ..... F25D 3/08

[52] U.S. Cl. ..... 62/457; 62/459; 62/463

[58] Field of Search ..... 62/457, 458, 459, 371, 62/372, 529, 530, 463, 464, 465; 220/409, 412

[56] References Cited

U.S. PATENT DOCUMENTS

| | | | |
|---|---|---|---|
| 416,356 | 12/1889 | Clark | 62/459 X |
| 594,413 | 11/1897 | Medberry et al. | 62/464 X |
| 1,074,453 | 9/1913 | Park | 62/457 X |
| 1,186,418 | 6/1916 | Mischo | 62/457 |
| 1,745,556 | 2/1930 | Pendleton | 62/463 X |
| 1,782,720 | 11/1930 | Franklin | 62/459 X |
| 4,265,095 | 5/1981 | McConachie | 62/457 X |

FOREIGN PATENT DOCUMENTS

| | | | |
|---|---|---|---|
| 1124666 | 8/1968 | United Kingdom | 220/409 |

*Primary Examiner*—Lloyd L. King
*Attorney, Agent, or Firm*—Gunn, Lee & Jackson

[57] ABSTRACT

In the preferred and illustrated embodiments of the present apparatus, a rack or platform standing above the bottom of an ice chest is disclosed. The rack is a generally horizontal planar member having a number of slots or openings formed therein, and further comprising a set of feet which support the horizontal member in an elevated position. An alternate preferred embodiment is preferably divided into a pair of similar portions, the two portions joining together, one portion having a set of hollow legs with receptacles therein and the other portion having two sets of tabs which protrude for insertion into the hollow legs. One set of tabs is insertable into the receptacles in the hollow legs to align the two portions, thereby forming a large planar expanse, the two being parallel and coextensive. An alternate arrangement of the two portions secures one of the two portions horizontally and the other is set at a right angle to enable division of an ice chest into two separate portions.

9 Claims, 13 Drawing Figures

FIG. 1
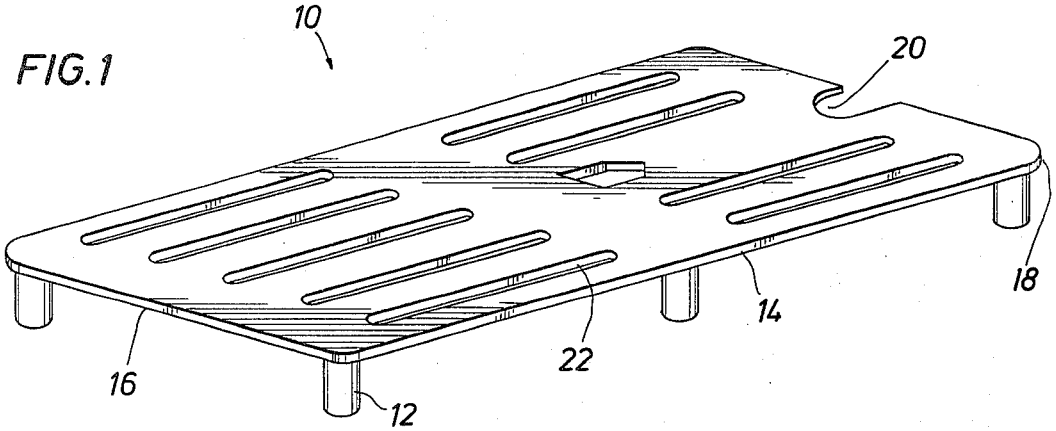
FIG. 2
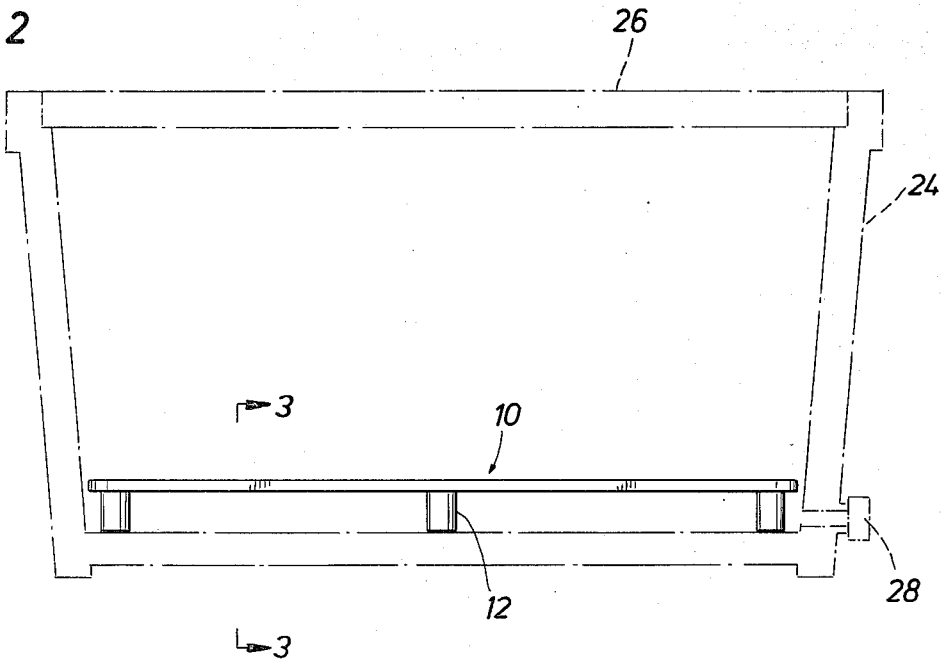
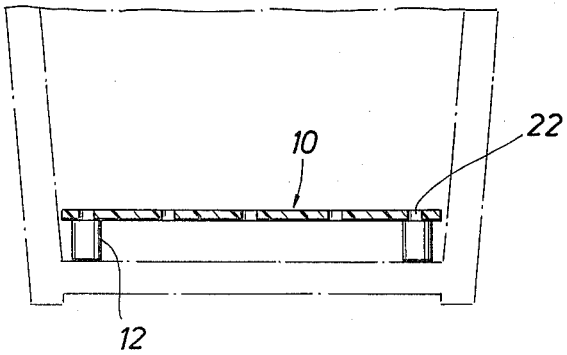
FIG. 3

FIG. 7
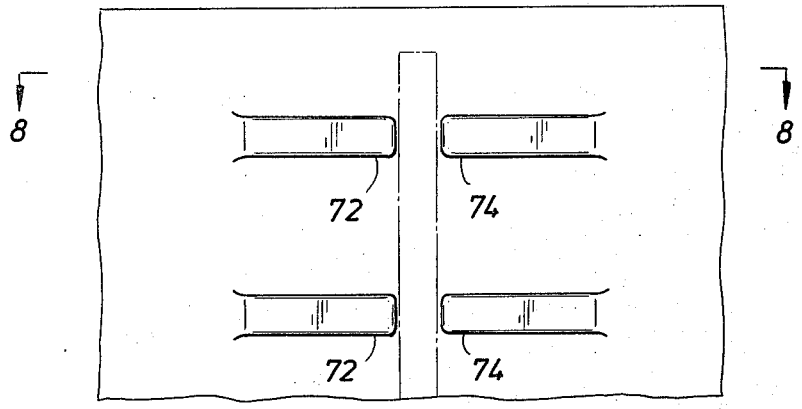
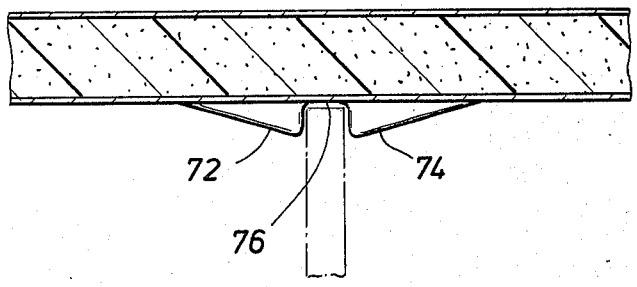
FIG. 8
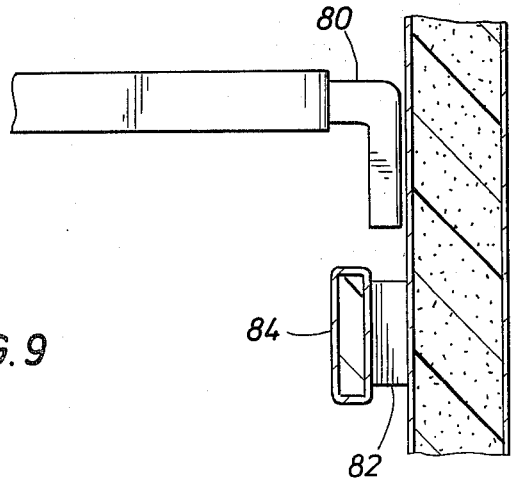
FIG. 9

FIG. 10
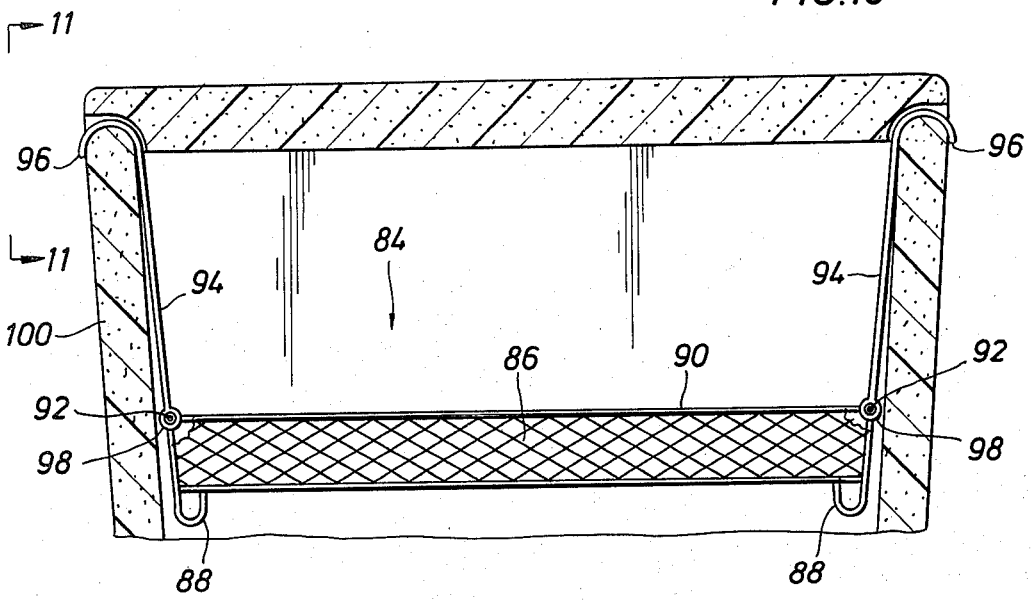
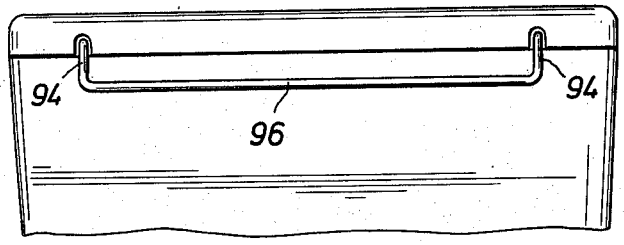
FIG. 11
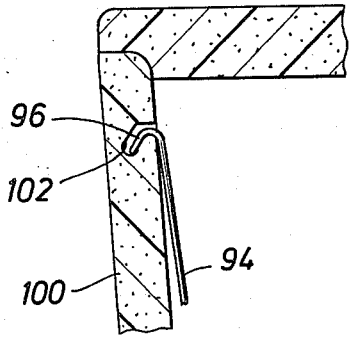
FIG. 12
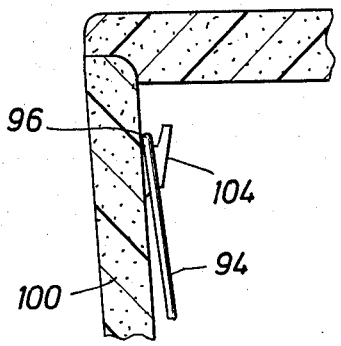
FIG. 13

ICE RACK FOR USE IN PORTABLE ICE CHEST

BACKGROUND OF THE DISCLOSURE

This disclosure is directed to an apparatus which can be inserted or removed from an ice chest. It is particularly useful with a portable ice chest. A portable ice chest is normally chilled by placing crushed ice in the chest. As the ice melts, it accumulates water on the bottom. The water has a tendency to soak certain stored items. In the instance of canned beverages in glass or metal containers, this poses no particular problem. By contrast, this is a more significant problem in the instance of storing paper wrapped products which wrapping might not fully exclude the water. This would apply to sandwiches and bread. This would also apply to various and sundry pastries. In large part, soaking depends on the integrity of the wrapping; it is not likely that the wrapping will stay completely dry on the interior for extended periods. The tendency to soak the wrapping and hence the product protected by the wrapping is cumulative. It is also aggravated because the ice melts and accumulates water in the bottom of the portable ice chest.

Racks to be positioned in the bottom of an ice chest have been devised heretofore. One such rack is described in U.S. Pat. No. 2,663,157 of Laramy. This shows a rack which is hinged so that the hinged portion can be swung aside. U.S. Pat. No. 4,255,944 of Gardner discloses leg supports. There are a number of limitations in devices of this sort. For instance, the present invention has the combination of a pair of racks which are selectively placed adjacent to one another, thereby providing a broad expanse of support area and which apparatus also enables the two portions to be arranged perpendicular to one another thereby dividing the ice chest into separate areas. The present apparatus does not include a hinge with moving parts which are susceptible of rust or freezing as a result of rust. The present apparatus tolerates water without damage. Moreover, the present apparatus includes a lock mechanism whereby the two portions are locked at right angles. One of the deficiencies of the Laramy apparatus is the pivot without a fixed angular position and the required moving parts. Moreover, the present apparatus provides adequate flexibility to the user such that the alternate preferred embodiment has the two forms which are most convenient and most significant to the user. The apparatus of this disclosure is, therefore, summarized as comprising an elevated rack adapted to be placed within an ice chest. The apparatus utilizes legs extending from a flat planar portion, there being a number of perforations in the planar portion, and the planar portion is preferably divided into two parts. One part incorporates four legs to obtain stability. Two of the legs are arranged at one end and they are formed into pockets or receptacles. The second portion includes two sets of tabs which are sized and aligned for stabbing into the receptacles. This enables the second portion to be positioned parallel and coextensive with the first portion, or alternatively, standing at a right angle.

The user of this device has a number of choices in use. As an example, the food products may be kept above the water resulting from melting ice. The food protection avoids smell and contamination as typically occurs on storing recently caught fish prior to cleaning. The ice water picks up the slime or protective coating found on most fish species. It is usually undesirable to get this slime on the food or food packages. In part, this is accomplished by compartmentalizing the ice chest through the use of this unobvious rack. Division into compartments allocates to the user several option such as a single shelf extending fully across the ice chest. Another choice involves side located lugs and mating rings or hooks in the ice chest to hang a rack. This permits alternate elevations of the installed rack in the chest.

In a simplified alternate embodiment, the apparatus includes a set of legs supporting a large planar surface with a number of perforations therein to drain ice placed on the rack.

BRIEF DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

FIG. 1 is a perspective view of a rack adpated to be inserted in a portable ice chest in accordance with the teachings of the present invention which rack includes a plurality of legs supporting a sheet plastic member of generally rectangular configuration having a plurality of holes formed therein;

FIG. 2 of the drawings is a side view of the rack of FIG. 1 showing the rack placed within a portable ice chest to support food and other materials in the ice chest above the crushed ice and the water accumulated from melting ice;

FIG. 3 is a sectional view along the line 3—3 disclosing the rack of the present invention in the ice chest;

FIG. 7 depicts a set of alignment tabs in the ice chest to locate the installed multipart rack;

FIG. 8 is a sectional view along the line 8—8 of FIG. 7 illustrating details of construction of the alignment tabs;

FIG. 9 is a view of side located cooperative hooks and lugs for handing the rack at a desired elevation in the chest;

FIG. 10 discloses an alternate form of food support apparatus in an ice chest disclosing a means for elevating the food on a platform;

FIG. 11 is a detailed view of the hanger support mechanism shown in FIG. 10 illustrating details of construction;

FIG. 12 shows an alternate form of hanger support contrasted to the form shown in FIG. 11; and FIG. 13 discloses even another form of hanger support contrasting with those shown in FIGS. 10 and 12.

DETAILED DESCRIPTION OF THE PREFERRED EMBODIMENT

Figure 4:
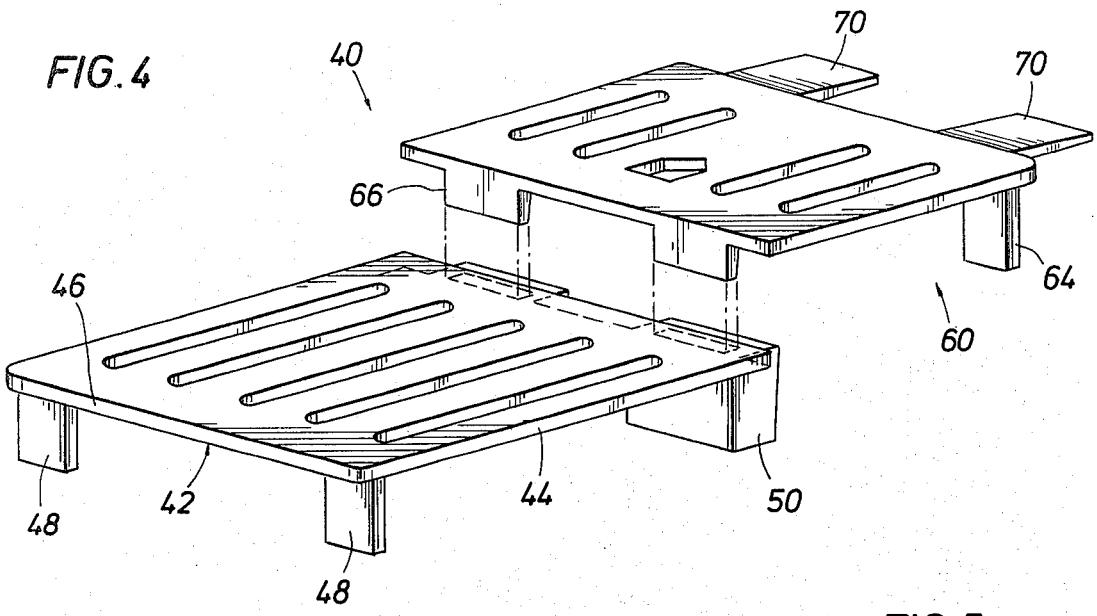
FIG. 4 is a perspective view similar to FIG. 1 showing an alternate preferred embodiment of the present apparatus which divides into two portions.

Attention is first directed to FIG. 1 of the drawings where a rack 10 is illustrated in perspective. The rack 10 is constructed with a number of parallel, downwardly extending, cylindrical legs 12. In the embodiment shown, there are six and they are arranged in rows along the rack edges. The preferred embodiment incorprates six; the number can be varied depending on the weight and expanse of the apparatus. It also depends on the weight of materials to be placed on the rack. The legs are of modest length, typically being in the range of about two to nine centimeters.

The rack of FIG. 1 includes a large transverse sheet plastic member. It is formed with a generally rectangular shape having a long side 14 and a relatively short side 16 to fit within a particular size of ice chest. They define a rectangle. At the corners, the sides join at rounded corners 18. They are rounded to enable the rack to fit within a molded portable ice chest. Most portable ice chests are constructed with rounded inside corners. It is desirable, therefore, to round the inside corners of the apparatus shown in FIG. 1. These corners are rounded to a radius of curvature centering on the adjacent support legs, there being a support leg at each corner. The four corners that comprise the rectangle of the structure shown in FIG. 1 are thus rounded, and are located in near proximity to the four corner legs.

The rectangular profile is defined by four edges, there being two short sides and two longer sides. One of the short sides is notched at 20. The notch 20 serves as a convenient hand hold to grab the apparatus and to lift it from the ice chest. The notch 20 is cut at one edge. It can be conveniently duplicated at the opposite end as desired. Ordinarily, one is sufficient.

The rack 10 is described as a planar member of rectangular shape. It is best formed of sheet plastic material having a finite thickness typically in the range of about one centimeter. Typically, a clear or translucent plastic can be used. In the alternative, the plastic can be opaque or at least partially so. The plastic that is used is typically one which can withstand colder temperatures without becoming brittle. It will be recognized that the apparatus is submerged in chilled water. Typically, the temperature within the ice chest will be no colder than minus five or minus ten degrees C. The plastic which is chosen prefereably remains somewhat pliable without becoming imbrittled at this temperature range.

The apparatus is made of relatively thin plastic stock. It is formed into a large sheet. The sheet is preferably rectangular as recited before. However, there are a number of holes or slots formed in the sheet, one such being identified by the numeral 22. The slot 22 is duplicated at many locations. This enables any ice which happens to be on the top of the rack to melt and the water from melting will drip through the rack, and the ice will eventually fall through the rack. This enables the ice and the water from the melting ice to accumulate in the bottom of the ice chest. Moreover, it enables cooling of the food stuffs supported on the rack. It is, therefore, generally desirable that the rack be perforated at many locations. A solid sheet without perforations is less desirable because it will impede cooling of the food stuffs and drainage of water. FIGS. 2 and 3 jointly show the rack 10 of the present apparatus in an ice chest. There, an ice chest is generally identified by the numeral 24, and has a removable lid or cover 26. A drain spigot or tap 28 is usually included to drain ice water from the chest. This enables the ice chest to be recharged with fresh ice after draining and even while leaving the food in the chest. In fact, chilled game and fish may be left in the chest.

Attention is directed to FIG. 4 of the drawings where the numeral 40 identifies an alternate preferred embodiment. The embodiment of FIG. 4 is made of two sections which are joined together in the manner described below. The first section comprises a first rack 42. The rack 42 is again constructed of planar stock and has a generally rectangular shape. The long side is identified by the numeral 44. The short side of the rectangle is identified by the numeral 46. It is generally rectangular in shape and is supported on four legs. Rectangular legs are shown at 48. There are preferably two of this construction and they are preferably identical. In this instance, they are shown as rectangular stock material although they could just as easily be of round stock as depicted in FIG. 1. They extend by a specified length below the planar rack portion.

While the legs 48 are formed of solid stock, this is not the case of the legs 50. There are two legs 50 which are preferably identical to one another arranged at the far end of the rectangular rack 42. In actuality, the rack 42 comprises only a portion. There is an additional portion which joins to it as will be described. The joinder utilizes receptacles within the legs 50. Attention is momentarily directed to the sectional view of FIG. 5 where the leg 50 is shown to include a vertical wall 52 and a second wall 54. The wall 54 is spaced from the wall 52, and the two are almost parallel. They are not parallel; rather, they define between the two a tapered slot or cavity which is larger at the upper end and tapers to a more narrow opening at the bottom. The leg 50 is a hollow receptacle from top to bottom, being open at the top. It is also open at the bottom to drain easily. There is no necessity for closing over the bottom of the receptacle in the leg 50. As will be appreciated, the receptacle is a generally rectangular receptacle when considered in cross-section; the top end of the receptacle is exposed. So to speak, the receptacle is located at the marginal edge of the first rack 42. It is located at the marginal edge to expose it to an overlapped relationship with respect to the second rack as will be described. There are two of them in the preferred embodiment, and they are arranged in line with one another. Ideally, they are also aligned with the solid legs 48 previously discussed.

Figure 5:
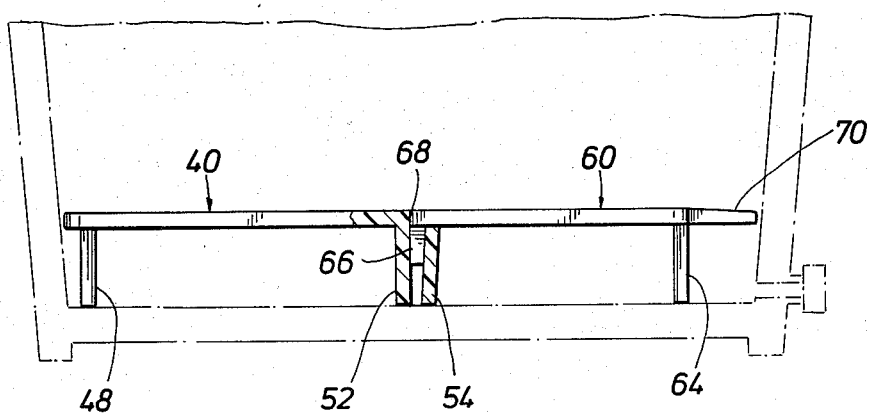
FIG. 5 is a view similar to FIG. 2 showing the two portions joined together to form a coextensive ice rack received within a portable ice chest.

FIG. 4 shows a second rack which is generally identified by the numeral 60. The rack 60 is a companion rack for the rack 42. The two racks join together. The rack 60 is constructed with a rectangular planar member 62. It is equal in width to the rack 42; it is preferably about as long a the rack 42 and this is a convenient division of the two to thereby provide equal surface areas between the two racks. The rack 60 is preferably rectangular in shape, and both racks are provided with perforations or openings in the them to drain ice and water through them. The perforations shown in the two racks are similar to the perforations shown in FIG. 1 in the rack 10. Moreover, the second rack 60 is supported on four legs. It includes a pair of solid legs 64 which are quite similar to the legs 48 previously mentioned. They are approximatley equal in length to the legs 48 so that they can all be rested on a common support area as shown in FIG. 5. The legs 64 provide two of the legs for the second rack 60. Additional legs are obtained by utilization of the receptacle-shaped legs 50 on the first rack 42.

To this end, the second rack 60 includes a pair of identical downwardly protruding lock tabs 66. The lock tabs 66 stab into the upwardly facing open receptacles in the two legs 50. The lock tabs 66 are identical to one another. The lock tabs 66 are, therefore, dimensioned to fit within the receptacles. They are preferably slightly tapered. This achieves something of a wedging shape as they are stabbed into the receptacle and makes joinder of the two racks into a single unit easily accomplished. The two tabs 66 are located at one edge of the second rack 60. They are located preferably at the edge and on the lower side thereof, thereby defining a facing edge on the second rack which abuts against a mating edge of the first rack. The point of joinder of the two edges is identified by the numeral 68 in FIG. 5. Preferably, the planar sheets snugly align against one another.

The second rack 62 is thus supported on four legs as shown in FIG. 5. The legs 64 are integrally constructed with the second rack 60; the seacond rack 60 borrows the legs 50 from the first rack. The legs 50 in the first rack are offset to the side to enable them to be positioned beneath both the first and second racks as better shown in FIG. 5. This provides good structural support to the first and second racks. Moreover, they are joined together and will be observed in FIG. 5 to function and operate as a single rack of relatively broad expanse.

Figure 6:
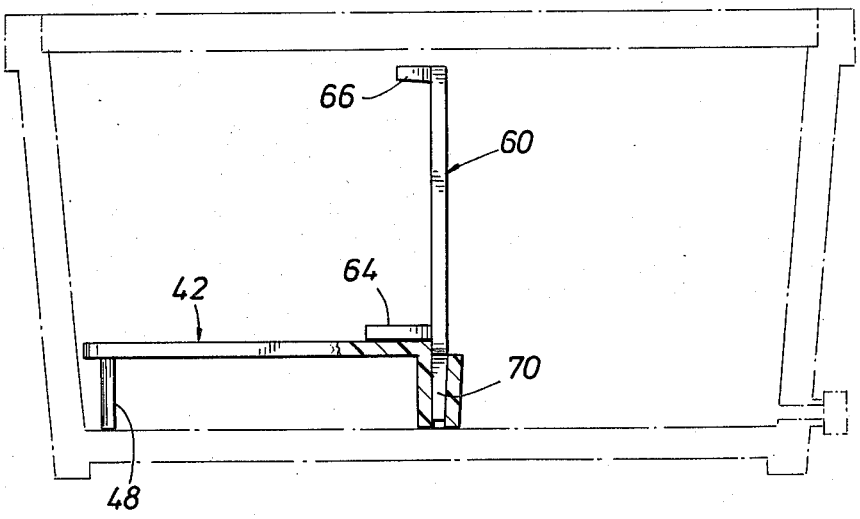
FIG. 6 is a view similar to FIG. 5 showing the two portions arranged at right angles to one another to divide the interior of the ice chest into separate chambers.

The rack 60 incorporates a second set of tabs. These are identified at 70. The tabs 70 are arranged along the opposite rectangular edge of the rectangular surface, the tabs 70 being opposite to the tabs 66. Moreover, the tabs 70 extend at an angle. The tabs 70 are coplanar with the second rack 60 and extend to the side from it. They are constructed of tapered material, and are generally rectangular in plan. The two tabs 70 are thus aligned with tabs 66 so that they can also fit in the receptacles within the legs 50. In FIG. 6 of the drawings, the second rack 60 is better shown with the tabs 70 stabbed into the receptacle legs. FIG. 6 discloses that the tabs 70 are somewhat longer than the tabs 66. They are longer and, therefore, have a longer tapered portion. They preferably stab into and are locked in placed, extending substantially fully through the receptacle legs 50.

Penetration by the second tabs 70 into the receptacle legs 50 is limited. The legs 64 are so located from the marginal edge that the legs 64 function as a stop tab in the arrangement of FIG. 6. Briefly, FIG. 6 shows the second rack 60 standing upright and supported on the first rack 42. The second rack is stabbed into the receptacles within the legs 50. Entry is limited by the legs 64. The protruding tabs 70 are permitted to rest for alignment and stabilization purposes within the receptacle legs.

In use, the embodiment 40 provides dual arrangements shown in FIGS. 5 and 6. In FIG. 5, the first and second rack portions are aligned with one another to provide a single rack. So to speak, the rack depicted in FIG. 5 is a large expanse, functioning as a single rack. In FIG. 6, the second rack 60 is extended above the top of the first rack 42 at right angles. This divides the ice chest into two compartments. Referring to FIG. 6, canned beverages and the like can be placed on the right. As a matter of fact, any material which has an adequate container can be placed on the right, even submerged in ice water. This is highly desirable for drinks which are in metal or glass containers. It provides contact with the ice water to thereby chill in an optimum fashion. On the other hand, the left side of the ice chest chamber and particularly that portion above the first rack 42 is high and elevated, thereby enabling food stuffs to be placed therein. They are kept dry because they are above the accumulated chilled water collected in the bottom of the ice chest. While they are high, they are sufficiently close to the chilled water and ice to be cool. They are not, however, submerged continuously in water which will eventually penetrate practically every kind of wrapping material. This avoid damage to the food stuffs. Moreover, it enables segregation of the two types of products.

The two types of products that are placed in the ice chest can be grouped depending on requirements. One group of products can be placed in the ice water on the right while the other is held high and dry on the left. The products on the left are not permitted to slide or accidentally tumble off the rack into the water on the right. The upstanding second rack 60 prevents this. It is a divider, so to speak, which segregates the ice chest into two separate types of storage.

From the foregoing, it will be observed that the first and second racks have two relative positions. They are preferably locked together in either position. The two positions shown in FIGS. 5 and 6 amply demonstrate the versitility of the first and second rack portions in cooperative arrangement. On the one hand, a conventional storage rack is provided; on the other hand, the two racks divide the chamber into separate storage areas where segregation of food stuffs depending on need is permitted.

The ice chest, as described to this point, is unmodified. The remaining drawings require ice chest modification. In FIGS. 7 and 8, a pair of spaced projecting tabs 72 and 74 define a locking groove 76. The tabs align the rack portions, and particularly the upstanding rack portion. The tabs are duplicated at upper and lower locations. They hold the rack of FIG. 6 upright and prevent teetering. They are sized to define a loose fit and need not be tight or snug.

In FIG. 9, a portion of the rack is shown, having a downwardly projecting lug 80. It is bent in the form of an L. The L lug reaches over and stabs into a cavity or gap within a hook made of three wall portions. There are two parallel end located walls 82 standing out from the ice chest wall. They support a third wall 84 parallel to the ice chest wall. The three walls define a U shaped hook extending from the ice chest wall. The hook defines an eye or cavity for the lug 80 to fasten the rack portions. The elevation of rack is dependent on the elevation of the hooks in the chest. Normally, four similar hooks at a common elevation will suffice. If desired, two or three sets may be installed at various elevations.

Attention is next direction to FIG. 10 of the drawings. This use sets forth a modified food support basket 84 shown in side view. It is a generally rectangular basket having a bottom and four surrounding upright walls 86. They are formed of expanded wire mesh; an alternate form is to utilize perforated plastic sheet stock. In both cases, the material is preferably rustproof and does not corrode. It is important to avoid this kind of damage in light of exposure to the water that inevitably collects in the ice chest.

The basket 84 in the preferred form is constructed with fairly large gauge wire at the edges and corners. The heavier wire is formed into four legs 88 located at the corners and extends equally therebelow to support the basket on a surface, typically on the bottom of the ice chest. In like fashion, the upstanding side walls are supported by a lengthwise reinforcing wire 90 around the top periphery. The two edges 90 are parallel to one another and extend the length of the basket. The rectangle is completed by means of similar top located edge wires 92. The four edge wires define a rectangle above the bottom.

The basket 84 as shown in FIG. 10 can support itself on the bottom. An alternate mode of installation in the ice chest is to hang it in the ice chest above the bottom. This can be accomplished by using upstanding hangers 94. Duplicate hangers are used at each end. Each hanger includes two generally parallel elongate arms. They extend upwardly and hook over the top lip of the ice chest, having a J-shaped hook. The J-shaped hook is shown in FIG. 10, lodged over the top lip of the open ice chest. The J-shapd hook is formed on both arms and the two are joined together by a transverse bar 96 better shown in FIG. 11. This unifies the hangers at each end; in other words, each end has a duplicate hanger and each hanger is formed of two arms so that the basket can be held in a horizontal position within the ice chest.

FIGS. 10 and 11 jointly show small notches cut in the top for the ice chest 100. The notches are relatively small as better shown in FIG. 11. These notches serve as receptacles for the hanger just described. In particular, they are included to enable the hanger to suspend the basket 84 within the ice chest above the water in the bottom of the ice chest. This is accomplished without letting the cold air in the ice chest escape. The cold air is prevented from escaping by forming very small notches, somewhat in the form of semi-circular notches in the lid to enable the lid to nest into the ice chest and to prevent thermal leakage.

The hanger at each end is thus formed of a pair of parallel downwardly extending arms which terminate in circling hooks 98. The hooks 98 engage the transverse wires 92 which define the framework of the basket 86. A complete circle is permissible so that the hooks are permanently attached. This avoid misplacing the hooks. Alternately, the hooks can be formed into partial circles so that they have a slot whereby the hooks can be selectively engaged or disengaged.

The hook arrangement shown in FIGS. 10 and 11 is more than satisfactory. An alternate approach, however, is shown in FIG. 12. The J-shaped hanger is bent to a slightly different radius of curvature and is positioned within a notch 102 cut in the wall of the ice chest 100. The notch or slot 102 is cut across the face of the end wall of the ice chest. For instance, the bar 96 might be six inches long. The notch shown in FIG. 12 should be at least six inches in length to accommodate the bar 96. The hanger is then fully enclosed within the ice chest and there is no need to modify the lip joining the lid to the ice chest. By contrast, another form is shown in FIG. 13, and this utilizes a wall mounted hook 104 on the interior of the ice chest. Again, if the hanger 96 is six inches in length, it is preferable to use two or three hooks covering a span of slightly less than six inches on the interior of the ice chest. The depth which is required is a scale factor and can be varied. It serves as a wall mounted hook to receive the hanger. In this instance, it is not necessary to bend the hanger into a J-shaped hook. Rather, hooking is accomplished by the transverse bar 96 which comprises a portion of the hanger structure.

Benefits to Hunters and Fishermen

This apparatus is particularly beneficial to those who hunt or fish. Assume that some game has been taken or fish has been caught. The example is all the more common with fish. Freshly taken game or fish has a high quality which rapidly deteriorates dependent on field conditions. This is accelerated by soaking the fish in the blood and natural fish slime which inevitably accumulates in the bottom of most ice chests. This common approach used by sportsmen does provide the cooling, but it also aggravates the problem by accumulating the slime in close and intimate contact with the game or fish. This is true where the fish has not been cleaned. It is somewhat reduced where the fish has been cleaned and only filets are stored.

The apparatus disclosed herein is quite valuable because it permits an improved procedure for storage of the fish and game. Briefly, a layer of ice is placed on the platform described in this disclosure and the game or fish is layed over the layer of ice. Assume that this is several freshly caught and cleaned fish. If another layer of ice is poured over the stored fish, the fish is reduced in temperature. An important factor is the relatively slow and continual trickling of water from the melting ice over the stored fish. In a fashion, this washes the fish while maintaining a very high humidity. This reduces water logging and deterioration as a result of the decay which occurs with such game or fish. The water which is accumulated in the bottom of the ice chest is below the game or fish and does not wash the slime, blood and other water soluable constituents over the game or fish. It is particularly improved if the ice chest is drained once or twice daily. Such draining has the advantage of carrying away the accumulated ice melt and the water soluable products which are in water. This extends the cooler life of the game or fish. Typically, actual decay is retarded, and even delayed for several days. It maintains the game or fish in a state where it is almost but not quite frozen and is exposed to high humidity. In fact, this procedure can be used with certain live fish, as an easy example, crabs. It appears that they are able to come back to life, the chilling apparently anesthetizing the crabs. Whatever the case, it is ideal to maintain the game or fish in an environment where the temperature is about 32° F., perhaps with a margin of 3° or 4° in either direction. The margin is dependent on a number of factors.

While the foregoing is directed to the preferred embodiment of the present invention, other and further embodiments of the invention may be devised without departing from the basic concept thereof, and the scope thereof is determined by the claims which follow.

I claim:

1. A rack adapted to be used within a portable ice chest which comprises:

(a) a first rack portion having:

(1) a generally planar portion adapted to support food stuffs placed thereon;

(2) leg means extending downwardly from said planar portion for supporting said planar portion within an ice chest;

(3) additional leg means having hollow receptacles therein which leg means additionally supports said planar portion within the ice chest;

(4) wherein said receptacles within said additional legs comprise a joinder means;

(b) a second rack portion having:

(1) a generally planar portion adapted to be optionally coextensive with the planar portion of said first rack portion;

(2) downwardly extending legs adapted to support said second rack portion parallel to and coplanar with said first rack portion;

(3) tab means coacting with said receptacles in the legs of said first rack portion to secure said first and second rack portions in a planar arrangement within an ice chest;

(4) second tab means for alternately securing said second rack portion at an angle with respect to said first rack portion coacting with said receptacles in said legs.

2. The apparatus of claim 1 further including perforations formed in the planar portions of both of said first and second rack portions.

3. The apparatus of claim 1 wherein said receptacles are open tapered receptacles conforming to and matching said tab means and said second tab means to alternately receive both of said tab means.

4. The apparatus of claim 1 wherein both of said planar portions are coplanar on placing said tab means in said receptacles and both of said planar portions terminate at matching edges abutted against one another.

5. The apparatus of claim 1 including a lock tab on said second rack portion located to limit entry of said second tab means into said receptacles.

6. The apparatus of claim 1 including two open ends on said receptacles, one end exposed at the top end of said additional leg means and having a shoulder on the exterior of said additional leg means for aligning said second rack portion.

7. The apparatus of claim 6 wherein said receptacles are duplicated at spaced locations, and said tab means have corresponding spaced locations between duplicated tabs comprising said tab means.

8. The apparatus of claim 1 including groove means defined by a pair of spaced and opposing tab means on an interior wall of the ice chest spaced and sized to support said second rack portion.

9. The apparatus of claim 1 further including edge located protruding lug means on said rack portions positioned to selectively engage cooperative hook means affixed to the interior wall of the ice chest at an elevation above the bottom portions of the ice chest.

* * * * *